US010384366B2

(12) United States Patent
Cooley et al.

(10) Patent No.: US 10,384,366 B2
(45) Date of Patent: Aug. 20, 2019

(54) PUSH-STICKS FOR SAWS AND STORAGE SYSTEMS THEREOF

(71) Applicant: Lowe's Companies, Inc., Mooresville, NC (US)

(72) Inventors: Adriane Dian Cooley, Cornelius, NC (US); Benjamin Worth Coble, Cornelius, NC (US); Kevin C. Y. Chang, Anderson, SC (US)

(73) Assignee: LOWE'S COMPANIES, INC., Mooresville, NC (US)

( * ) Notice: Subject to any disclaimer, the term of this patent is extended or adjusted under 35 U.S.C. 154(b) by 566 days.

(21) Appl. No.: 14/499,446

(22) Filed: Sep. 29, 2014

(65) Prior Publication Data

US 2016/0089809 A1 Mar. 31, 2016

(51) Int. Cl.

| | |
|---|---|
| ***B27B 5/29*** | (2006.01) |
| ***B27B 25/10*** | (2006.01) |
| ***B27B 27/02*** | (2006.01) |
| ***B27B 27/08*** | (2006.01) |

(52) U.S. Cl.

CPC ..... *B27B 25/10* (2013.01); *B27B 5/29* (2013.01); *B27B 27/02* (2013.01); *B27B 27/08* (2013.01)

(58) Field of Classification Search

CPC ..... B27B 25/10; B27B 27/08; B27B 5/29; B27B 27/02; Y10T 83/6534

See application file for complete search history.

(56) References Cited

U.S. PATENT DOCUMENTS

| | | | | |
|---|---|---|---|---|
| 2,696,852 | A * | 12/1954 | Dunton | B27B 25/10 144/242.1 |
| 2,739,625 | A | 3/1956 | Peters | |
| 2,985,202 | A * | 5/1961 | Wilson | B27B 25/10 144/307 |
| 4,485,711 | A | 12/1984 | Schnell | |
| D278,022 | S * | 3/1985 | Ash | D7/649 |

(Continued)

FOREIGN PATENT DOCUMENTS

| | | |
|---|---|---|
| CN | 2437465 | 7/2001 |
| CN | 103140330 | 6/2013 |

(Continued)

OTHER PUBLICATIONS

Patent Cooperation Treaty, International Search Report and Written Opinion, International Application PCT/US2015/052201 dated Dec. 9, 2015.

(Continued)

*Primary Examiner* — Jonathan G Riley

(74) *Attorney, Agent, or Firm* — Kilpatrick Townsend & Stockton LLP

(57) ABSTRACT

Embodiments of the present invention provide improved storage options for push-sticks used in connection with rip fences on table saws and similar cutting devices where push-sticks might be used. The push-stick storage system may include a rip fence and a push-stick retention mechanism. The push-stick retention mechanism may be defined by upright side walls that define a channel or slot therebetween for receiving a push-stick. The retention mechanism may also include a stop (or a stop block) positioned at a first position within the channel, and a retainer positioned at a second position within the channel.

29 Claims, 7 Drawing Sheets

(56) References Cited

U.S. PATENT DOCUMENTS

| | | | | |
|---|---|---|---|---|
| 5,018,773 | A * | 5/1991 | Stavin | B27B 25/10 294/209 |
| 6,135,521 | A * | 10/2000 | Wirth, Jr. | B27B 25/10 294/15 |
| 6,578,461 | B1 | 6/2003 | Loo | |
| 8,763,504 | B2 * | 7/2014 | Tardif | B27B 25/10 83/438 |
| 2006/0123961 | A1 * | 6/2006 | Fontaine | B27B 25/10 83/436.2 |
| 2006/0185485 | A1 | 8/2006 | Wang | |
| 2007/0245869 | A1 | 10/2007 | Welsh et al. | |
| 2008/0053284 | A1 | 3/2008 | Miller et al. | |
| 2011/0214541 | A1 | 9/2011 | Rybka | |
| 2012/0006170 | A1 | 1/2012 | Frolov et al. | |
| 2012/0036974 | A1 | 2/2012 | Koegel | |
| 2014/0352512 | A1 * | 12/2014 | Smith | B27B 27/02 83/447 |

FOREIGN PATENT DOCUMENTS

| | | | | |
|---|---|---|---|---|
| CN | 203460275 | | 3/2014 | |
| DE | 544013 | C * | 2/1932 | B27B 25/10 |
| DE | 544013 | C | 2/1932 | |
| DE | 102008050475 | A1 * | 4/2008 | |
| EP | 1847347 | A2 | 10/2007 | |

OTHER PUBLICATIONS

Ryobi-Branded—RTS20 as available before Sep. 29, 2014.
Dewalt-Branded—DW744X as available before Sep. 29, 2014.
Ridgid-Branded—R4510 as available before Sep. 29, 2014.
Porter Cable-Branded—PCB 220TS as available Sep. 29, 2014.
Skilsaw-Branded—3310-01 as available Sep. 29, 2014.
Bosch-Branded—4100-09 as available Sep. 29, 2014.
CA2962928_Canadian First Exam_May 18, 2018.
CN201580052855.1, "Office Action", dated Oct. 23, 2018, 23 pages.

* cited by examiner

PUSH-STICKS FOR SAWS AND STORAGE SYSTEMS THEREOF

FIELD OF THE DISCLOSURE

Embodiments of the present disclosure relate generally to push-stick storage systems and methods for storing push-sticks that can be used with various types of saws.

BACKGROUND

A push-stick is a safety device used in connection with saws having cutting blades. Push-sticks are generally used to aid in pushing the material to be cut (sometimes referred to as a "work-piece") along a surface toward a saw blade in order to protect an operator's hands. A push-stick may be a shaped length of wood, plastic, metal, or other material that helps control the movement of the work-piece on a saw surface. Push-sticks are most commonly used on table saws, jointers, router tables, and band saws.

Push-sticks find particular use when the distance between the cutting blade and a rip fence is too small for an operator's hand to safely push the material to be cut past the edge of the saw. As shown in FIG. 9, a rip fence "R" is a guide that runs generally parallel to the cutting plane of a saw blade "B", from the front of the table to the back of the table. The rip fence R acts as a guide that helps woodworkers cut wood evenly, precisely, and safely. Most rip fences are formed as what looks like a metal bar that runs parallel to the saw blade. Rip fences often have opposing vertical surfaces to permit the fence to be positioned and used on either side of a saw blade. The saw operator can adjust the distance of the rip fence from the blade, according to the width of the cut to be made and the location on the work-piece where the cut is to be made) A push-stick "P" is generally used to prevent the operator from cutting his/her hands when pushing the work-piece material through the blade area. Rather than pushing the wood with bare hands, woodworkers use the push-stick to push the wood as it is moved through a saw. If the wood kicks back (for example, from a knot in the wood or if the pressure applied to the work-piece is not well controlled), then it is the push-stick that runs into the blade, not the woodworker's hands. In addition to being a safety measure, push-sticks can also help provide better control of the pressure on the work-piece, resulting in smoother, cleaner cuts.

Underwriters Laboratories Inc.'s (UL) standards for table saws specify that one push-stick be provided on all table saws and that storage for the push-stick be included on the saw. There are currently a number options in the market for providing and storing a push-stick, many of which include storing the push-stick on the side of the table saw. In many such instances, the push-stick is stored on the side of the table either using a hook and slot system or using one or more spring clips positioned along the side of the table. In another design, the push-stick is stored along an outer vertical surface of a rip fence. However, improved storage options for push-sticks are desired and provided herein.

BRIEF SUMMARY

Embodiments described herein thus provide improved storage options for push-sticks used in connection with rip fences on a table (or other saw). The push-stick storage system may include a rip fence and a push-stick retention mechanism. The pushstick retention mechanism may be defined by upright side walls that define a channel or slot therebetween for receiving a push-stick. The retention mechanism may also include a stop (or a stop block) positioned at a first position within the channel, and a retainer positioned at a second position within the channel.

In one example, there may be provided a push-stick storage system for use with a saw, comprising: (a) a rip fence comprising upright side walls that define a slot therebetween for receiving a push-stick, (b) a stop positioned at a first position within the slot, and (c) a retainer positioned at a second position within the slot. The retainer may be a spring clip that is adapted to retain a push-stick within the slot. The spring clip may have first and second inward legs that are adapted to press against a push-stick when the push-stick is positioned in the slot and are adapted to release the push-stick in response to application of an upwardly directed force on the push-stick. In a specific example, the slot may be between about one half inch to about one inch wide. In use, it is possible for the push-stick to be removably stored in the slot of the rip fence. Each of the upright side walls of the rip fence may provide a generally unobstructed outer surface for use in guiding a work-piece.

In another example, there may be provided a push-stick storage system for use with a saw, comprising: (a) rip fence comprising two major surfaces that are substantially parallel to each other, wherein each of the two major surfaces is adapted to allow a work-piece to slide therealong during a cutting operation; and (b) a push-stick retention mechanism in the rip fence that is adapted to retain a push-stick such that the push-stick does not obstruct the sliding of the work-piece along either of the major surfaces when the push-stick is retained in the push-stick retention mechanism. The push-stick retention mechanism may have a slot in an upper surface of the rip fence, the slot being adapted to receive at least a portion of the push-stick. The push-stick retention mechanism may also have a stop and a retainer positioned in the slot that are adapted to retain a push-stick between the two major surfaces of the rip fence. The stop and retainer may be positioned to facilitate engagement of the stop by a tip of a push-stick and to facilitate pivoting of the push-stick after such engagement toward the retainer to achieve retention of the push-stick. The stop and retainer may be positioned such that retention of the push-stick occurs when an upper edge of the push-stick is substantially flush with, or below, the upper surface of the rip fence, except for a handle of the push-stick which extends out from the slot to facilitate grasping of the handle by a user during removal of the push-stick from the retention mechanism. The retainer may be a spring clip. The push-stick may be removably secured by the push-stick retention mechanism.

In another example, there may be provided a push-stick storage system for use with a saw, comprising: a rip fence comprising two substantially vertical and elongate surfaces, each of which is adapted to allow a work-piece to slide therealong during a cutting operation; and a push-stick retention mechanism in the rip fence that is adapted to retain a push-stick such that the push-stick does not obstruct the sliding of the work-piece along either of the substantially vertical and elongate surfaces when the push-stick is retained in the push-stick retention mechanism. The push-stick retention mechanism may have a slot in an upper surface of the rip fence, the slot being adapted to receive at least a portion of the push-stick. The push-stick retention mechanism may have a stop and a retainer positioned in the slot that are adapted to retain a push-stick between the two substantially vertical and elongate surfaces of the rip fence. The stop and retainer may be positioned to facilitate engagement of the stop by a tip of a push-stick and to facilitate pivoting of the push-stick after such engagement toward the retainer to achieve retention of the push-stick. The stop and retainer may be positioned so that retention of the push-stick occurs when an upper edge of the push-stick is substantially flush with, or below, the upper surface of the rip fence, except for a handle of the push-stick which extends out from the slot to facilitate grasping of the handle by a user during removal of the push-stick from the retention mechanism. The retainer may be a spring clip. The push-stick may be removably secured by the push-stick retention mechanism.

In another example, there may be provided a push-stick storage system for use with a table saw having an upper work surface, comprising: (a) a rip fence comprising two elongate and substantially straight surfaces, each of which is adapted to guide a work-piece along a straight line as the work-piece is slid across the upper work surface of the saw; and (b) a push-stick retention mechanism in the rip fence that is adapted to retain a push-stick such that the push-stick does not obstruct the sliding of the work-piece along either of the elongate and substantially straight surfaces when the push-stick is retained in the push-stick retention mechanism. The push-stick retention mechanism may have a slot in an upper surface of the rip fence, the slot being adapted to receive at least a portion of the push-stick. The push-stick retention mechanism further may have a stop and a retainer positioned in the slot that are adapted to retain a push-stick between the two elongate and substantially straight surfaces of the rip fence. The stop and retainer may be positioned to facilitate engagement of the stop by a tip of a push-stick and to facilitate pivoting of the push-stick after such engagement toward the retainer to achieve retention of the push-stick. The stop and retainer may be positioned so that retention of the push-stick occurs when an upper edge of the push-stick is substantially flush with, or below, the upper surface of the rip fence, except for a handle of the push-stick which extends out from the slot to facilitate grasping of the handle by a user during removal of the push-stick from the retention mechanism. The retainer may be a spring clip. The push-stick may be removably secured by the push-stick retention mechanism.

In another example, there may be provided a table saw comprising: (a) a work-piece support surface; (b) a cutting member adapted to cut a work-piece while the work-piece is supported on the work-piece support surface; (d) a push-stick for use when pushing a work-piece during a cutting operation; and (e) a rip fence comprising (i) upright side walls that define a slot therebetween; (ii) outer surfaces adapted to guide a work-piece during use; (iii) a stop block positioned at a first position wholly or at least partially within the slot; and (iv) a retainer positioned at a second position wholly or at least partially within the slot to retain the push-stick in place at least partially within the slot and configured such that the push-stick, stop block, and the retainer do not obstruct sliding of a work-piece along either of the outer surfaces of the rip fence. The table saw may also include (f) a storage feature on the housing for storing the rip fence and push-stick when not in use.

These and other embodiments of the present invention are described in greater detail in the Detailed Description that follows.

DETAILED DESCRIPTION

The subject matter of embodiments of the present invention is described here with specificity to meet statutory requirements, but this description is not necessarily intended to limit the scope of future claims. The subject matter to be claimed may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

While the configurations of this disclosure are particularly well-suited for use in connection with a powered table saw, such configurations can also be employed, or readily adapted to be employed, in connection with various other types of saws and cutting devices having work-piece support surfaces. Non-limiting examples of such saws and cutting devices include jointers, router tables, band saws, and miter saws. Because the general operations and features of such saws are known, only the portions that are related to the safety push-stick configuration are shown and discussed herein. It should be understood, however, that the present disclosure can relate to any cutting device that includes a push-stick or other similarly shaped safety feature.

As discussed above, a push-stick is used to prevent an operator of a saw from cutting his/her hands when pushing a work-piece material through a blade area. Rather than pushing the wood with bare hands, woodworkers use the push-stick to push the wood as it is moved through a saw. Push-sticks can also help provide better control of the pressure on the work-piece through the saw, resulting in smoother, cleaner cuts. Table saws typically include a rip fence which generally acts as a guide that helps woodworkers cut wood evenly, precisely, and safely. In use, the rip fence runs parallel to the saw blade, and the saw operator can adjust the distance of the rip fence from the blade, according to the width of the cut to be made and the location on the work-piece where the cut is to be made. The side of the rip fence is used to guide the work-piece during cutting. The present disclosure provides a system for storing a push-stick in relation to a rip fence, ensuring that the push-stick is visible and accessible when the rip fence is used.

Figure 1:
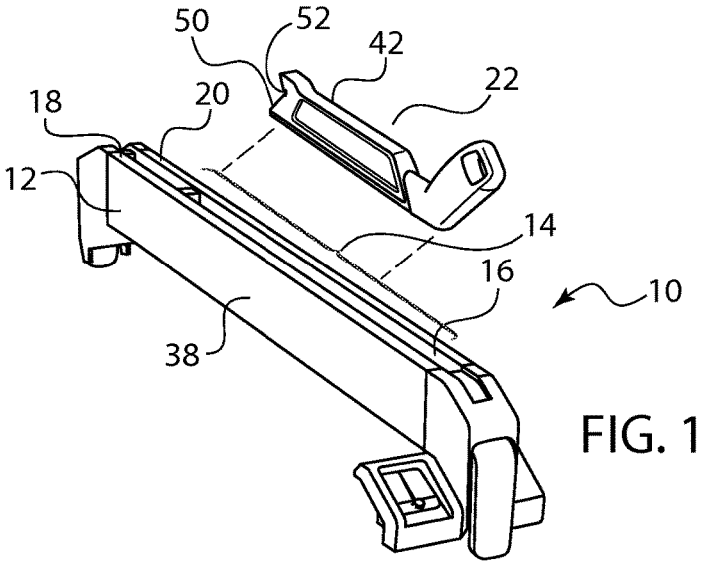
FIG. 1 shows a side perspective view of a rip fence having a channel designed to receive a push-stick within the channel.

Various embodiments of the present disclosure provide improved storage for push-sticks. Particular embodiments are useful in connection with table saws that use a rip fence. As shown in FIGS. 1-4, the storage system 10 includes a rip fence 12 that has a push-stick retention mechanism 14. The push-stick retention mechanism 14 may include a channel or a slot 16 formed between upright side walls 18, 20, as shown in FIG. 1. The push-stick retention mechanism 14, as outlined below, may include other features such as a stop block 24 and/or a retainer 30. Referring now to the channel 16, which is positioned between the upright side walls 18, 20 and forms a slot for receiving the push-stick 22, the channel 16 is sized and dimensioned to receive at least a portion of a push-stick 22. The channel or slot 16 is generally positioned along an upper portion of the rip fence 12.

The push-stick 22 used with the described storage system 10 may be any commercially available push-stick. A push-stick 22 can also be made by the saw owner from stock wood sizes or other materials. In some embodiments, the push-stick 22 may be sold with a table saw or may be sold separately.

The dimensions of the channel or slot 16 can depend on a number of factors including, for example, the dimensions of the push-stick 22 to be stored, the desired dimensions of the rip fence 12, the size of a table saw, the materials from which the rip fence 12 or push-stick 22 are to be constructed, and others. The width of the channel 16 and push-stick storage area is designed, in some embodiments, so that it can accept stock or standard push-sticks, as well as similar push-sticks (e.g., replacement push-sticks) created from stock wood width sizes of about ½" and/or about ⅝", in the event that the original push-stick 22 is lost or damaged. In general, the channel 16 can have a width suitable to securely hold and store a desired push-stick 22, but also remain easily accessible when use is desired. The channel 16 is generally sized such that it can accommodate various sizes and styles of push-sticks. For example, in one embodiment, the channel 16 is between about one half inch and about one inch wide. In another embodiment, the channel 16 is about ⅝ inch wide. In another embodiment, the channel 16 is less than about an inch wide.

Figure 4:
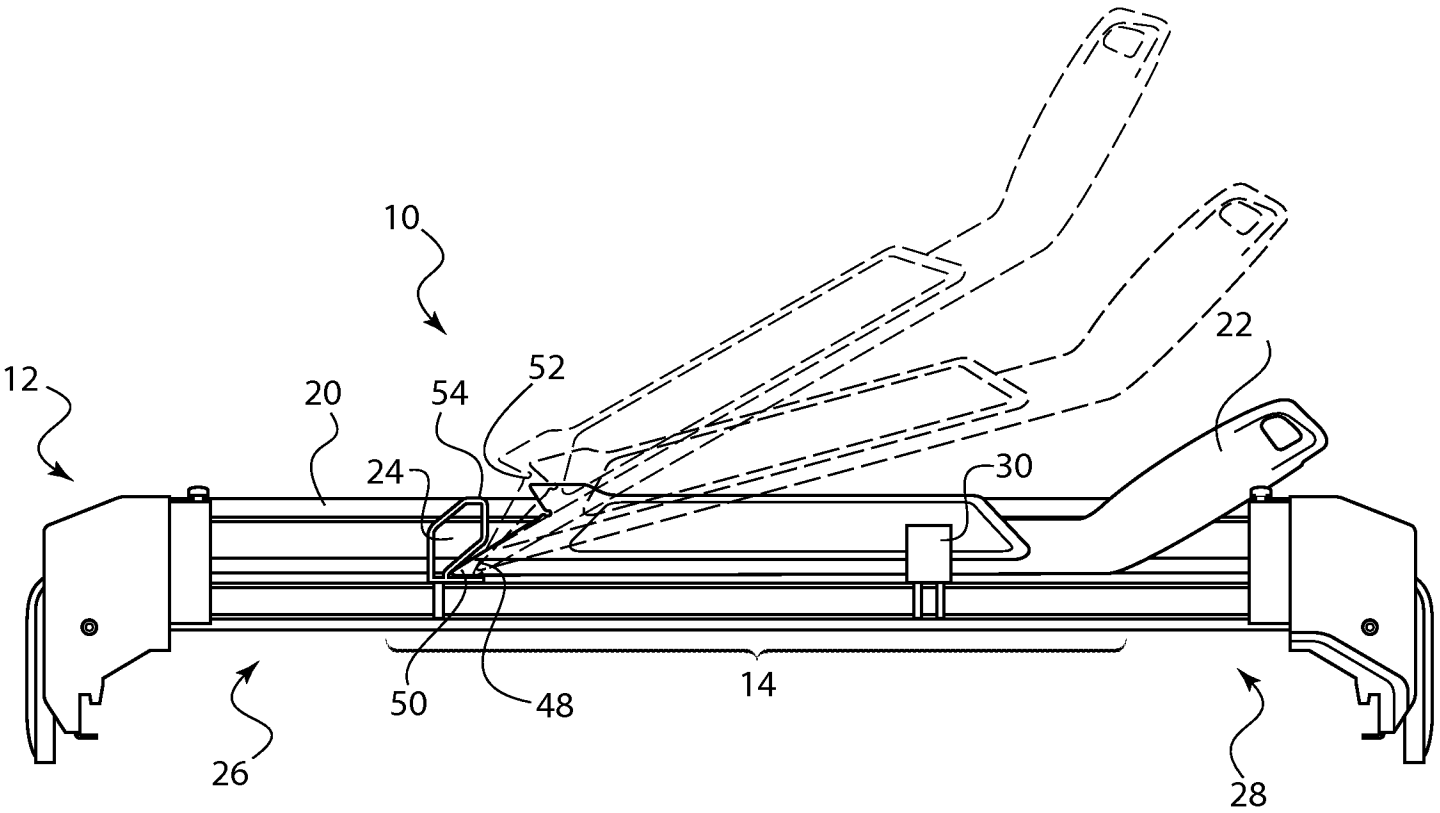
FIG. 4 shows a side view of one embodiment of a rip fence with one of its upright walls removed in order to show the channel between the upright side walls, and illustrating the insertion of the push-stick into a secured position.

A push stick retention mechanism 14 may be used to secure the push-stick 22 in place. The retention mechanism 14 may include the above-described slot/channel 16, as well as a stop block 24, a retainer 30, or any combination thereof. As shown in FIG. 4 (which illustrates the interior of the channel 16, with one of the upright side walls of the rip fence 12 removed), a stop block 24 can be provided in the channel 16. The stop block 24 is shown as being positioned toward one end 26 of the rip fence 12. It should be understood that the stop block 24 can theoretically be positioned at a variety of locations along the rip fence 12, so long as sufficient clearance is allowed for at least a portion of the length of the push-stick 22 to be positioned within the channel 16. For example, the stop block 24 may be positioned closer to the other end 28 of the rip fence 12. In another embodiment, the stop block 24 may be more centrally located along the rip fence 12. FIG. 4 illustrates the stop block 24 as having a receiving space 48. Receiving space 48 is formed as an indentation area on the block 24.

Figure 2:
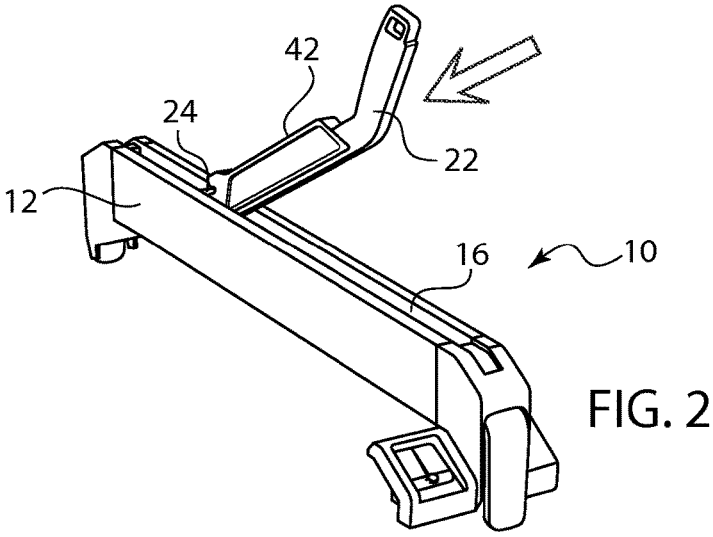
FIG. 2 shows the rip fence of FIG. 1 with a push-stick being inserted into the channel.
Figure 3:
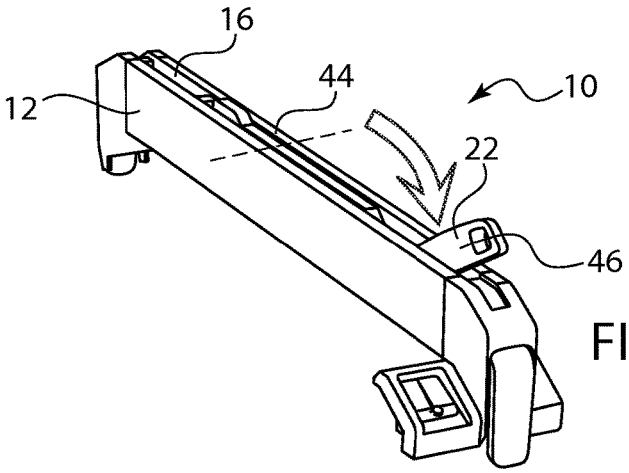
FIG. 3 shows the rip fence of FIG. 1 with the push-stick fully inserted into the channel.

As shown in FIGS. 2 and 3, in use, a tip 50 of the push-stick 22 is positioned against the receiving space 48 of the stop block 24. When pressure is applied to the push-stick 22 in the direction of the arrow in FIG. 3, the push-stick is received into the channel 16. A tip 50 of the push-stick 22 may be secured under a protrusion 54 of the block 24. This can help maintain the push-stick 22 in position. This may also help prevent rattling or movement of the push-stick, such that it is secured with respect to the stop block 24. It should be understood that the stop block 24 may be used with or without a separate retainer 30 (as described below). It should also be understood that a retainer feature may be incorporated into the stop block 24, if desired. It should also be understood that a retainer can be provided without incorporating a stop block 24 into the push-stick retention mechanism 14.

Figure 5:
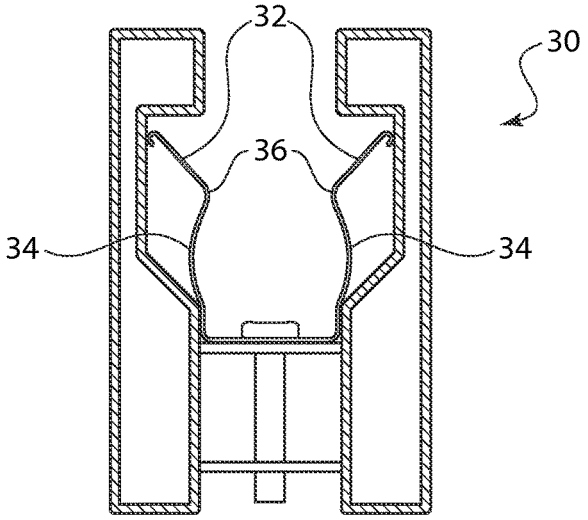
FIG. 5 shows an end plan view of one embodiment of a spring clip that functions as a retainer.

The push-stick retention mechanism 14, as illustrated in the embodiment shown, may also include a retainer 30 positioned in the channel 16. The retainer 30 is provided to securely receive and maintain the push-stick 22 in position when it is stored in the channel 16. As shown in FIG. 5, in one embodiment, the retainer 30 may be one or more spring clips 32. In the embodiment shown, the spring clip 32 provides an inward pressure toward the push-stick 22 when the push-stick is positioned in the channel 16. The spring clip 32 is designed to release the push-stick 22 upon an upwardly applied pressure (e.g., lifting of the push-stick 22). FIG. 5 shows an end plan view of one embodiment of a spring clip 32 that may be used. The spring clip 32 is shown as having a pair of bent legs 34 with inward-most portions 36 that create a pressure against the push-stick to be retained. Spring clips 32 may be manufactured of metal, plastic, or any other appropriate material. Alternative spring clips known to those of skill in the art can also be used.

In another embodiment, the retainer 30 in the channel 16 may be a magnet that secures to a magnetic surface on the push-stick. In another embodiment, the retainer 30 may be moveable side tabs that fit into a corresponding slot (or corresponding slots) on the push-stick. In another embodiment, the retainer 30 may be friction fit, such that the retainer has a receiving taper and the push-stick has a corresponding taper that creates a friction fit with the receiving taper, but that can be overcome with appropriate upward pressure. In another embodiment, the retainer 30 may be a latch and lever combination.

Figure 11:
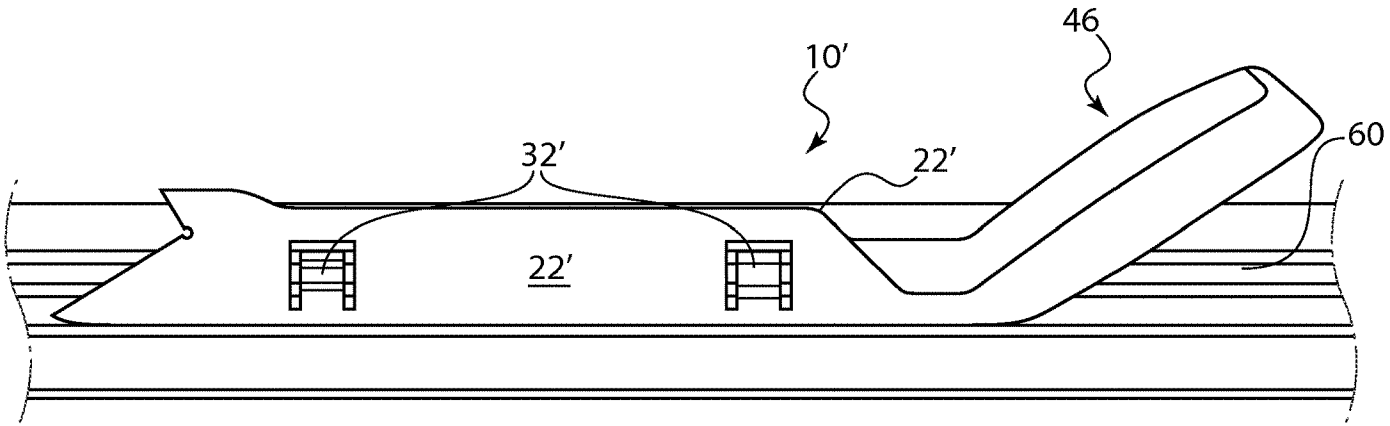
FIG. 11 shows a cross-sectional view of the rip fence and push-stick of FIG. 10 taken along Line XI-XI of FIG. 10.
Figure 12:
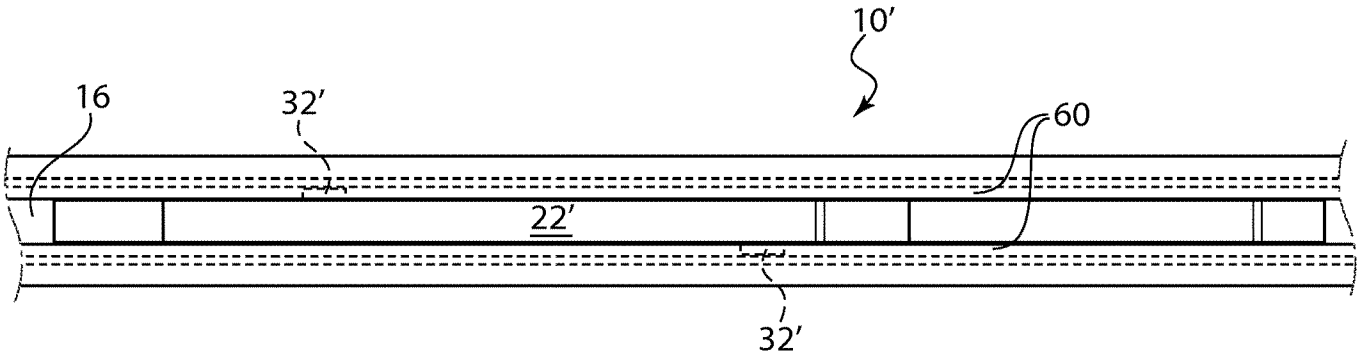
FIG. 12 shows a top view of the rip fence and push-stick of FIGS. 10 and 11.
Figure 10:
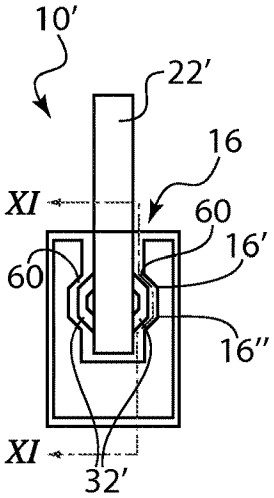
FIG. 10 shows an end view of an example of a rip fence with recessed channel walls and a push-stick equipped with clips that engage recesses in the channel walls.

In another embodiment, as shown in FIGS. 10-12, a push-stick storage system 10' comprises a recess 60 on one or both vertical sides of the channel 16 and one or more flexible clips and/or protrusions 32' that are included with, or attached to, a push-stick 22'. The flexible clip(s) and/or protrusion(s) 32' can be molded or cut into the push-stick 22' during manufacturing of the push-stick 22' or can be added after the rest of the push-stick 22' is manufactured.

When the push-stick 22' is inserted into the channel 16, the flexible clip(s) and/or protrusion(s) 32' are pushed into the push-stick 22' by an upper portion 16' of a corresponding channel wall 16" until the push-stick is fully inserted, at which time the flexible clip(s) and/or protrusion(s) 32' snap or slide into a corresponding one of the recesses 60. This engagement of the flexible clip(s) and/or protrusion(s) 32' tends to resist removal of the push-stick 22' from the channel 16. In some embodiments of the system 10', the flexible clip(s) and/or protrusion(s) 32' are configured so that the resistance to removal prevents the force of gravity from removing the push-stick 22' from the channel, regardless of whether the rip fence 12 is turned sideways or upside down. A user of the rip fence 12, however, can overcome this resistance by pulling on the push-stick 22' or by pulling a handle 46 of the push-stick 22', to remove the push-stick 22' from the channel 16. It should be understood that other retainers, or similar structures, may be used and is considered within the scope of this disclosure.

The stop block 24 and retainer 30 are positioned to facilitate engagement of the stop 24 by a tip of the push-stick 22. They then facilitate pivoting of the push-stick 22 after such engagement toward the retainer 30 in order to achieve retention of the push-stick 22 in place. For example, as shown in FIGS. 2-4, when the tip 50 of the push-stick 22 is inserted against the receiving space 48 of the block 24, this creates a pivot point that causes downward pressure on the push-stick to position the push-stick 22 in the channel 16. The tip 50 of the push stick can then be received under the protrusion of the block 24.

FIGS. 1-3 show a push-stick being positioned in the retention mechanism 14 of the rip fence 12. The stop 24 and retainer 30 are located at or within the slot 16, and are positioned so that retention of the push-stick 22 occurs when an upper edge 42 of the push-stick 22 is substantially flush with, or below, the upper surface 44 of the rip fence 12. Although not shown, it is also possible for the upper edge 42 of the push-stick 22 to extend above the upper surface 44 of the rip fence. In some embodiments, the push-stick can be sufficiently retained such that the push-stick does not rattle or become dislodged from the rip fence. As shown in FIG. 3, a handle 46 of the push-stick may be allowed to extend out from the slot 16 in order to facilitate grasping of the handle 46 by a user during removal of the push-stick 22 from the retention mechanism. The handle 46 can also be grasped by a user to adjust the position of the rip fence in some embodiments.

Although specific embodiments of a push-stick retention mechanism have been described, it should be understood that any feature or combination of these features that function to retain the push-stick 22 in place may collectively be referred to as a push-stick retention mechanism 14.

Figure 6:
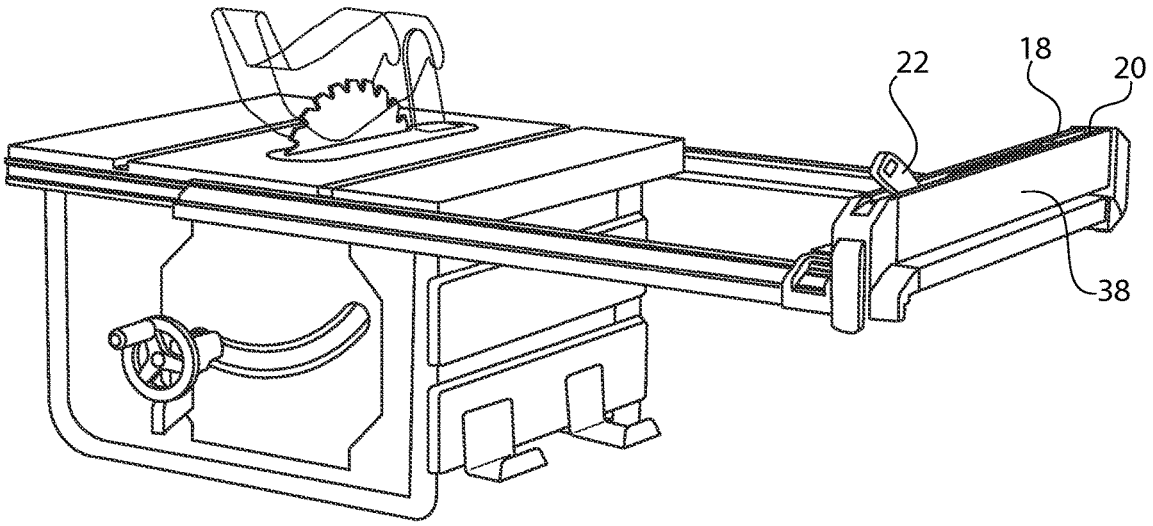
FIG. 6 shows a side perspective view of a table saw with a rip fence containing a push-stick in a channel positioned thereon.

As illustrated by FIGS. 1 and 6, each of the upright side walls 18, 20 of the rip fence 12 is provided with a generally unobstructed outer surface 38. These unobstructed outer surfaces 38 provide an elongate surface that can be used to guide a work-piece. The outer surfaces 38 may be referred to as major surfaces, vertical surfaces, elongate surfaces, or straight surfaces. The general concept to be understood is that storing the push-stick in the channel 16 between the two upright side walls 18, 20 of the rip fence 12 provides two outer surfaces 38 of the rip fence 12 that are unobstructed (e.g., there is not a storing hook or clip or any feature on either side of the walls). One of the benefits of providing unobstructed outer surfaces 38 on the rip fence 12 is that both sides of the rip fence are left smooth or straight or otherwise clear for use as a cutting guide. Thus, the rip fence can readily be employed on either side of a saw or other cutting blade. This is in contrast to methods that store a rip stick on one of the outer sides of the fence, leaving only one side of the fence unobstructed. Such a design generally requires the fence to be turned around if the work-piece is to be guided along what would be the push-stick storage side.

Figure 7A:
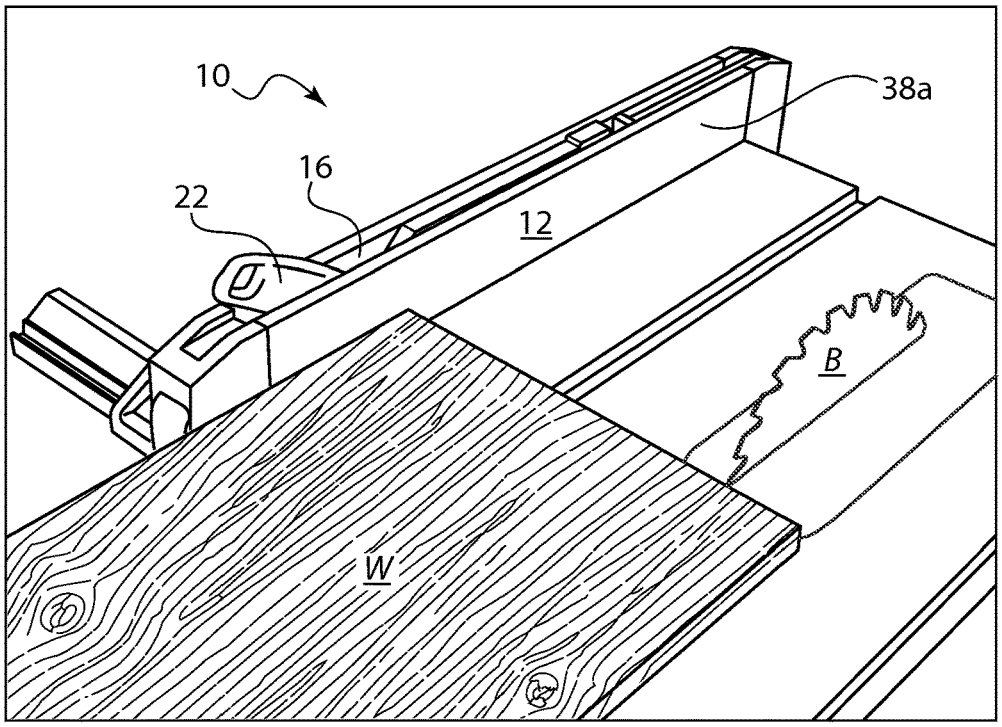
FIG. 7A shows a side perspective view of a first side of a rip fence being used to guide a work-piece.
Figure 7B:
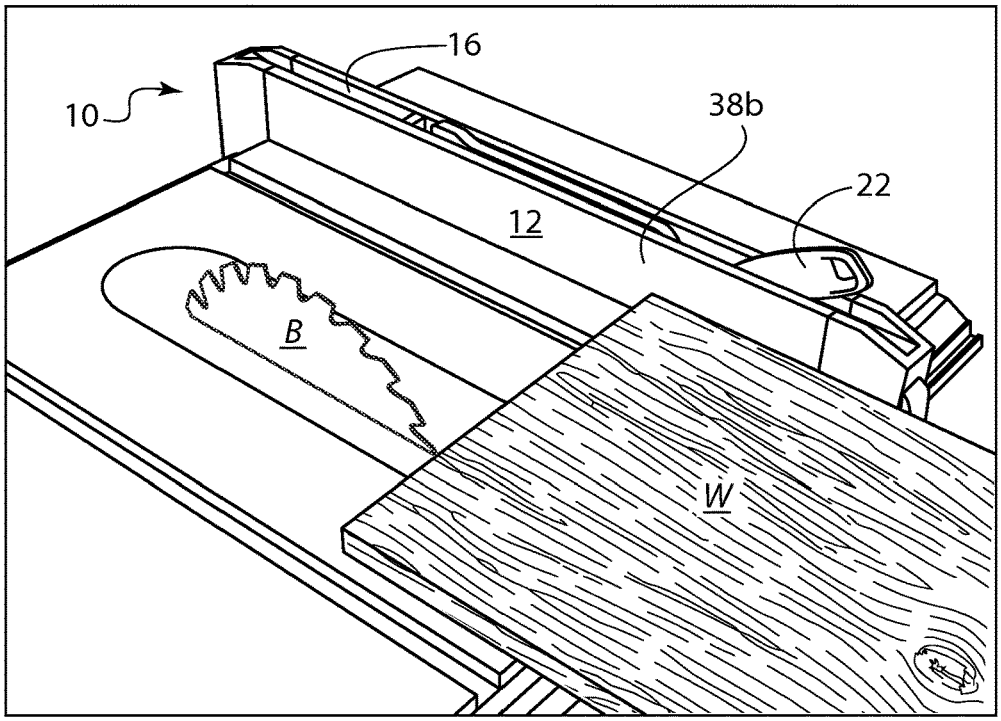
FIG. 7B shows a side perspective view of a second side of a rip fence being used to guide a work-piece.

FIGS. 7A and 7B illustrate the advantage provided by the present storage system 10 which utilizes a channel 16 of the rip fence 12 (and other features) to store the push-stick 22 leaving both outer surfaces 38 of the rip fence 12 unobstructed by any storage components. Because both surfaces 38 are generally straight or otherwise free and clear of any storage encumbrances (either stored items or structure to facilitate storage of items), a work piece "W" may be guided along the right outer surface 38*a* of the rip fence 12 as shown in FIG. 7A or along the left outer surface 38*b* of the rip fence 12 as shown in FIG. 7B. This leaves the rip fence 12 smooth on both sides, easily allowing cuts to be made on either side of the saw blade B. By storing the push-stick 22 within the channel 16 created by upright side walls 18, 20 of the rip fence 12, both sides 38*a*, 38*b* of the rip fence 12 are unobstructed and available for guiding the work piece W stock.

Figure 8:
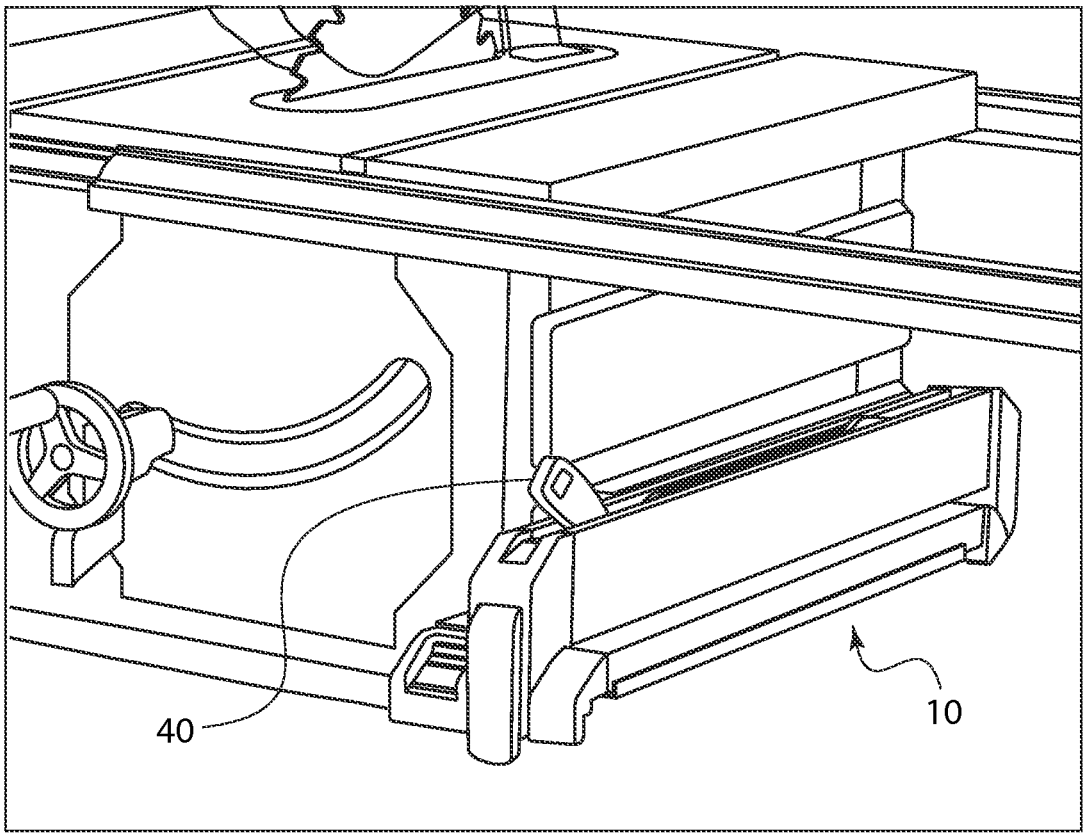
FIG. 8 shows one embodiment of a storage location for a push-stick/rip fence storage system.
Figure 9:
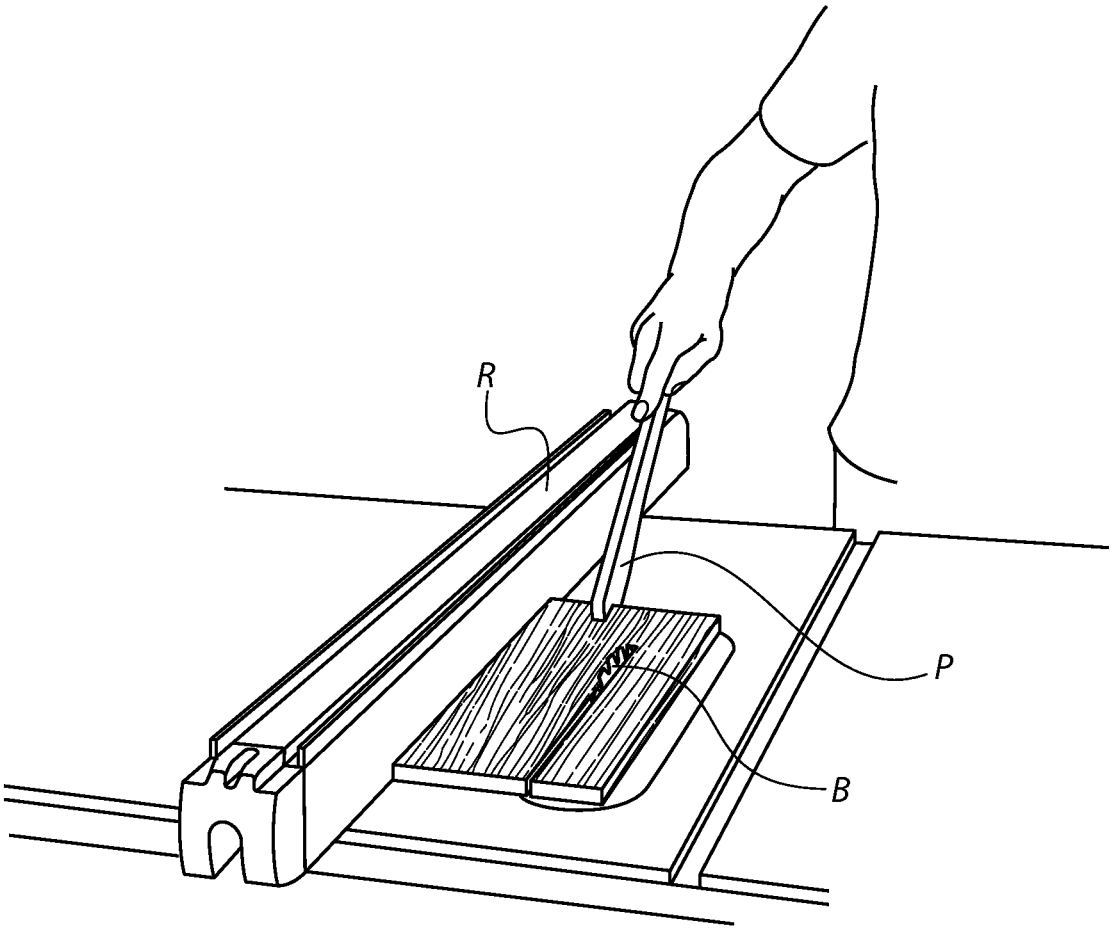
FIG. 9 shows an example of a prior art rip fence and its use with a push-stick.

The current design of storing the push-stick 22 within the rip fence 12 can also result in a safer and more convenient user experience. The push-stick 22 is more conveniently located by being positioned within a channel 16 on the rip fence 12. This storage location (integrated within the rip fence 12) means that the push-stick 22 is in plain sight and very accessible. When a user sets up a job on the saw, s/he will immediately see the push-stick and be more inclined to use it. As shown in FIG. 4, the push-stick 22 is generally captured within the rip fence channel 16 by a retainer 30, which secures the push-stick 22 in place during transport and set-up, but allows easy access as well. The stored push-stick is thus readily available while cutting. Another benefit of some embodiments of the storage system 10 provided is that because a push-stick is only required when a rip fence is in use, the two components can be conveniently stored together. The push-stick 22 remains stored within the rip fence 12 when the rip fence 12 is stored on the saw, for example, as shown in FIG. 8. This Figure shows a storage location 40 for the rip fence/push-stick combination on the side of the table saw. This is only one example of a potential storage location. Other storage locations may be on the saw stand, along the sides of the saw, mounted to a support on the table saw surface, or any other appropriate option.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A push-stick storage system for use with a saw, comprising:

(a) a rip fence comprising upright side walls that define a slot therebetween for receiving a push-stick, (b) a stop positioned at a first position within the slot, and (c) a retainer positioned at a second position within the slot.

2. The push-stick storage system of claim 1, wherein the retainer comprises a spring clip that is adapted to retain the push-stick within the slot.

3. The push-stick storage system of claim 2, wherein the spring clip comprises first and second inward legs that are adapted to press against the push-stick when the push-stick is positioned in the slot and are adapted to release the push-stick in response to application of an upwardly directed force on the push-stick.

4. The push-stick storage system of claim 1, wherein the slot is between one half inch and one inch wide.

5. The push-stick storage system of claim 1, further comprising the push-stick removably stored in the slot of the rip fence.

6. The push-stick storage system of claim 1, wherein each of the upright side walls of the rip fence provides a generally unobstructed outer surface for use in guiding a work-piece.

7. A push-stick storage system for use with a saw, comprising:

(a) a rip fence comprising two major surfaces that are substantially parallel to each other, wherein each of the two major surfaces is adapted to allow a work-piece to slide therealong during a cutting operation; and (b) a push-stick retention mechanism in the rip fence that is adapted to retain a push-stick such that the push-stick does not obstruct the sliding of the work-piece along either of the major surfaces when the push-stick is retained in the push-stick retention mechanism.

8. The push-stick storage system of claim 7, wherein the push-stick retention mechanism comprises a slot in an upper surface of the rip fence, the slot being adapted to receive at least a portion of the push-stick.

9. The push-stick storage system of claim 8, wherein the push-stick retention mechanism further comprises a stop and a retainer positioned in the slot that are adapted to retain the push-stick between the two major surfaces of the rip fence.

10. The push-stick storage system of claim 9, wherein the stop and retainer are positioned to facilitate engagement of the stop by a tip of the push-stick and to facilitate pivoting of the push-stick after such engagement toward the retainer to achieve retention of the push-stick.

11. The push-stick storage system of claim 9, wherein the stop and retainer are positioned such that retention of the push-stick occurs when an upper edge of the push-stick is substantially flush with, or below, the upper surface of the rip fence, except for a handle of the push-stick which extends out from the slot to facilitate grasping of the handle by a user during removal of the push-stick from the retention mechanism.

12. The push-stick storage system of claim 9, wherein the retainer comprises a spring clip.

13. The push-stick storage system of claim 7, further comprising the push-stick removably secured by the push-stick retention mechanism.

14. A push-stick storage system for use with a saw, comprising:

(a) a rip fence comprising two substantially vertical and elongate surfaces, each of which is adapted to allow a work-piece to slide therealong during a cutting operation; and (b) a push-stick retention mechanism in the rip fence that is adapted to retain a push-stick such that the push-stick does not obstruct the sliding of the work-piece along either of the substantially vertical and elongate surfaces when the push-stick is retained in the push-stick retention mechanism.

15. The push-stick storage system of claim 14, wherein the push-stick retention mechanism comprises a slot in an upper surface of the rip fence, the slot being adapted to receive at least a portion of the push-stick.

16. The push-stick storage system of claim 15, wherein the push-stick retention mechanism further comprises a stop and a retainer positioned in the slot that are adapted to retain the push-stick between the two substantially vertical and elongate surfaces of the rip fence.

17. The push-stick storage system of claim 16, wherein the stop and retainer are positioned to facilitate engagement of the stop by a tip of the push-stick and to facilitate pivoting of the push-stick after such engagement toward the retainer to achieve retention of the push-stick.

18. The push-stick storage system of claim 16, wherein the stop and retainer are positioned so that retention of the push-stick occurs when an upper edge of the push-stick is substantially flush with, or below, the upper surface of the rip fence, except for a handle of the push-stick which extends out from the slot to facilitate grasping of the handle by a user during removal of the push-stick from the retention mechanism.

19. The push-stick storage system of claim 16, wherein the retainer comprises a spring clip.

20. The push-stick storage system of claim 14, further comprising the push-stick removably secured by the push-stick retention mechanism.

21. A push-stick storage system for use with a table saw having an upper work surface, comprising:

(a) a rip fence comprising two elongate and substantially straight surfaces, each of which is adapted to guide a work-piece along a straight line as the work-piece is slid across the upper work surface of the saw; and (b) a push-stick retention mechanism in the rip fence that is adapted to retain a push-stick such that the push-stick does not obstruct the sliding of the work-piece along either of the elongate and substantially straight surfaces when the push-stick is retained in the push-stick retention mechanism.

22. The push-stick storage system of claim 21, wherein the push-stick retention mechanism comprises a slot in an upper surface of the rip fence, the slot being adapted to receive at least a portion of the push-stick.

23. The push-stick storage system of claim 22, wherein the push-stick retention mechanism further comprises a stop and a retainer positioned in the slot that are adapted to retain the push-stick between the two elongate and substantially straight surfaces of the rip fence.

24. The push-stick storage system of claim 23, wherein the stop and retainer are positioned to facilitate engagement of the stop by a tip of the push-stick and to facilitate pivoting of the push-stick after such engagement toward the retainer to achieve retention of the push-stick.

25. The push-stick storage system of claim 23, wherein the stop and retainer are positioned so that retention of the push-stick occurs when an upper edge of the push-stick is substantially flush with, or below, the upper surface of the rip fence, except for a handle of the push-stick which extends out from the slot to facilitate grasping of the handle by a user during removal of the push-stick from the retention mechanism.

26. The push-stick storage system of claim 23, wherein the retainer comprises a spring clip.

27. The push-stick storage system of claim 21, further comprising the push-stick removably secured by the push-stick retention mechanism.

28. A table saw comprising:

(a) a work-piece support surface;

(b) a cutting member adapted to cut a work-piece while the work-piece is supported on the work-piece support surface;

(d) a push-stick for use when pushing a work-piece during a cutting operation; and (e) a rip fence comprising (i) upright side walls that define a slot therebetween; (ii) outer surfaces adapted to guide a work-piece during use; (iii) a stop block positioned at a first position wholly or at least partially within the slot; and (iv) a retainer positioned at a second position wholly or at least partially within the slot to retain the push-stick in place at least partially within the slot and configured such that the push-stick, stop block, and the retainer do not obstruct sliding of a work-piece along either of the outer surfaces of the rip fence.

29. The table saw of claim 28, further comprising, (f) a storage feature on the housing for storing the rip fence and push-stick when not in use.

* * * * *